US008920616B2

(12) United States Patent
Chen et al.

(10) Patent No.: US 8,920,616 B2
(45) Date of Patent: Dec. 30, 2014

(54) PADDLE FOR ELECTROPLATING FOR SELECTIVELY DEPOSITING GREATER THICKNESS

(75) Inventors: Chao-Peng Chen, Fremont, CA (US); Jaswant Chudasama, Milpitas, CA (US); Pradeep Mishra, San Jose, CA (US); Chen-Li Lin, Fremont, CA (US); David Wagner, San Jose, CA (US)

(73) Assignee: Headway Technologies, Inc., Milpitas, CA (US)

( * ) Notice: Subject to any disclaimer, the term of this patent is extended or adjusted under 35 U.S.C. 154(b) by 233 days.

(21) Appl. No.: 13/525,510

(22) Filed: Jun. 18, 2012

(65) Prior Publication Data

US 2013/0334051 A1 Dec. 19, 2013

(51) Int. Cl.

| | |
|---|---|
| ***C25D 17/00*** | (2006.01) |
| ***C25D 21/10*** | (2006.01) |
| ***C25D 7/12*** | (2006.01) |
| ***C25D 5/16*** | (2006.01) |

(52) U.S. Cl.

CPC *C25D 17/00* (2013.01); *C25D 5/16* (2013.01); *C25D 17/001* (2013.01); *C25D 21/10* (2013.01); *C25D 7/123* (2013.01)

USPC ..... 204/279; 204/273; 205/95; 205/148; 205/157

(58) Field of Classification Search

None

See application file for complete search history.

(56) References Cited

U.S. PATENT DOCUMENTS

| | | | | |
|---|---|---|---|---|
| 3,652,442 | A * | 3/1972 | Powers et al. | 204/273 |
| 4,102,756 | A * | 7/1978 | Castellani et al. | 205/82 |
| 5,516,412 | A * | 5/1996 | Andricacos et al. | 204/224 R |
| 6,027,631 | A * | 2/2000 | Broadbent | 205/137 |
| 6,379,511 | B1 | 4/2002 | Fatula et al. | |
| 6,547,937 | B1 * | 4/2003 | Oberlitner et al. | 204/224 R |
| 6,669,833 | B2 * | 12/2003 | Kaja et al. | 205/96 |
| 6,800,186 | B1 | 10/2004 | Forand et al. | |
| 6,955,747 | B2 | 10/2005 | Browne et al. | |
| 7,160,421 | B2 * | 1/2007 | Wilson et al. | 204/229.4 |
| 7,169,280 | B2 | 1/2007 | Klocke et al. | |
| 7,294,244 | B2 * | 11/2007 | Oberlitner et al. | 204/273 |

(Continued)

FOREIGN PATENT DOCUMENTS

JP 2005/008911 A * 1/2005

OTHER PUBLICATIONS

Jet Plating Paddle, IBM Technical Disclosure Bulletin NA9203414, vol. 34, Issue 10A, pp. 414-415, Mar. 1992.*

*Primary Examiner* — Harry D Wilkins, III

(74) *Attorney, Agent, or Firm* — Saile Ackerman LLC; Stephen B. Ackerman

(57) ABSTRACT

An electroplating method is disclosed that selectively deposits a greater thickness of a metal or alloy layer on a region of wafer that has a higher thickness loss during a subsequent chemical mechanical polish process. A paddle assembly has three rectangular sides joined at their edges to form a triangle shape from an end view, and a notch in a bottom side that faces a wafer during the plating process. The notch extends along second and third paddle sides to a height up to about 50% of the paddle thickness. The thickness in a K-block region that has two sides formed parallel to the wafer flat is selectively increased by aligning a first side of the paddle notch side directly over one K-block side and aligning a second notch side directly over a second K-block side during a paddle movement cycle. The notch may be rectangular shaped or tapered.

27 Claims, 7 Drawing Sheets

(56) References Cited

U.S. PATENT DOCUMENTS

| | | | | |
|---|---|---|---|---|
| 7,390,383 | B2 * | 6/2008 | McHugh et al. | 204/273 |
| 7,393,439 | B2 * | 7/2008 | McHugh et al. | 204/273 |
| 7,569,131 | B2 * | 8/2009 | Hixon-Goldsmith et al. | 205/102 |
| 7,875,158 | B2 * | 1/2011 | Kuriyama et al. | 204/273 |
| 7,931,786 | B2 * | 4/2011 | Wilson et al. | 204/273 |
| 2008/0110751 | A1 * | 5/2008 | Oberlitner et al. | 204/273 |
| 2010/0176088 | A1 * | 7/2010 | Dunnebeil et al. | 216/83 |

* cited by examiner

PADDLE FOR ELECTROPLATING FOR SELECTIVELY DEPOSITING GREATER THICKNESS

TECHNICAL FIELD

The present disclosure relates to an electroplating method that leads to more uniform main pole layers in magnetic recording heads by selectively depositing thicker films on regions of a wafer that are susceptible to a higher chemical mechanical polish (CMP) thinning rate during a subsequent process step.

BACKGROUND

Electroplating methods are commonly used in numerous applications such as depositing metal films including copper interconnects in semiconductor devices and forming magnetic layers in magnetic recording devices. Although magnetic layers in read and write heads may be deposited by a sputtering method, an electroplating process is usually preferred because the sputtering process produces a magnetic layer with large magnetocrystalline anisotropy and higher internal stress. Electroplating is capable of generating a magnetic layer with a smaller crystal grain size and a smoother surface that leads to a high magnetic flux density ($B_S$) value and low coercive force ($H_C$).

In an electroplating process, an electric current is passed through an electroplating cell comprised of a working electrode (cathode), counter electrode (anode), and an aqueous electrolyte solution of positive ions of the metals to be plated on a substrate in physical contact with the cathode. By applying a potential to the electrodes, an electrochemical process is initiated wherein cations migrate to the cathode and anions migrate to the anode. Metallic ions such as $Fe^{+2}$, $Co^{+2}$, and $Ni^{+2}$ deposit on a substrate (cathode) to form an alloy that may be NiFe, CoFe, or CoNiFe, for example. The substrate typically has an uppermost seed layer on which a photoresist layer is patterned to provide openings over the seed layer that define the shape of the metal layer to be plated. Once the metal layer is deposited, the photoresist layer is removed. The magnetic layers which become a bottom pole layer and top pole layer in a write head can be formed in this manner.

During the manufacture of magnetic recording heads, the devices are typically built on an AlTiC wafer with a flat or notch along an edge of the wafer. The flat or notch may be used for orientation identification (in a plane with x-axis and y-axis dimensions) and is sometimes required for equipment such as exposure tools to process wafers. Unfortunately, the presence of a flat or notch can adversely produce poor within-wafer uniformity because of its asymmetric nature.

Referring to FIG. 1, an exemplary design is depicted of a wafer surface 40 that is laid out in a ten block configuration to facilitate a photolithography step as mentioned previously where a photoresist layer is patterned to form openings that define a shape of a main pole layer. There is a plurality of devices that will be formed within each block and each has a lengthwise dimension for the pole layer (from pole tip to back end) that is aligned parallel to the wafer flat. Note that the ten blocks are labeled A-H, J, and K. K-block is located next to the wafer flat 40*f* and has a lengthwise dimension "s" along the y-axis and parallel to the flat, and a widthwise dimension "w" along the x-axis direction and perpendicular to the flat. The blocks are essentially rectangles wherein J-block is formed next to an opposite side of the wafer with respect to the wafer flat, and A-H blocks are formed in two columns with four rows each between K-block and J-block. In this design, all blocks have a lengthwise dimension that is parallel to the wafer flat 40*f*. Half of the blocks are in an upper section of the wafer above midpoint M and half of the blocks are in the lower section of the wafer below the midpoint.

Referring to FIG. 2, within wafer uniformity is illustrated for a typical wafer after the electroplating and CMP steps. Region 1 has a main pole layer thickness that is near the mean value for the entire wafer while Region 2 has a thickness greater than the mean value. Region 3 that falls within K-block has a main pole thickness that is less than the mean value for the wafer. A low K-block thickness is not desired since it will negatively affect the EWAC (erase writer width under AC conditions) sigma for the magnetic recording heads on the wafer. Although a relatively uniform main pole layer thickness is achieved after the electroplating step, it is believed that asymmetry caused by the wafer flat along with a faster CMP removal rate near the wafer edge both contribute to the low K-block thickness issue following the polish step. Although the faster CMP removal rate at the wafer edge can be resolved by adjusting the retaining ring pressure of the wafer carrier during the CMP process, this modification still does not eliminate the K-block thickness issue. Further improvement is necessary to realize a higher degree of within wafer uniformity for main pole layer thickness such that essentially all of the devices on the wafer perform to a certain specification.

Another approach to overcome the low K-block thickness issue is to plate a thicker main pole layer in the k-block in order to compensate for a greater thinning rate in that region during the CMP step. However, it is very difficult to produce the desired plating thickness profile by using a conventional thief current adjustment method that involves a thief plate ring (auxiliary cathode) around the wafer during the plating process. Any localized thief current adjustment to the block of interest will also affect plating thickness in the remaining blocks. Thus, there is no available means to selectively plate a higher main pole layer thickness in certain regions of a wafer without affecting thickness in other regions. An improved electroplating method is desired that enables a thicker main pole layer to be formed in selected regions of a wafer while maintaining other magnetic properties in the electroplated layer.

SUMMARY

One objective of the present disclosure is to provide an electroplating method that deposits thicker magnetic films in selected regions of a wafer that have a higher thinning rate during a subsequent chemical mechanical polish (CMP) process such that within wafer uniformity is significantly improved after the CMP process.

A further objective of the present disclosure is to provide an electroplating method according to the first objective that provides a consistent main pole layer composition across the wafer, and that maintains within wafer electroplating thickness uniformity in the non-selected regions.

According to one embodiment of the present disclosure, an electroplating apparatus is employed that includes a tank filled with an electroplating solution, a wafer (work piece) attached to a cathode plate and surrounded by a thief plate at the bottom of the tank, an anode that is positioned in an upper portion of the plating solution, and a paddle having a notch formed therein that is attached to guide rails and moves back and forth over the wafer in a direction parallel to the wafer plane and at a fixed distance above the wafer surface. In one design scheme, the paddle has three rectangular surfaces of essentially equal shape that are joined at their lengthwise edges to form a triangular shape from an end view. Thus, the paddle has three rectangular sides in a middle section that connects two ends having a triangular shape. Optionally, the middle section may be round, square, or rectangular. The lengthwise dimension (length) of each of the three sides is along a first axis direction. One of the three sides is a bottom side that is aligned parallel to the wafer surface and faces the bottom of the tank. The bottom side has a width along a second axis direction wherein the second axis is perpendicular to the first axis. The remaining two sides extend from the bottom side and join at a top edge that is a first height distance along a third axis from the bottom side. The third axis is perpendicular to both of the first and second axes. Preferably, the length of each paddle side is greater than the diameter of the wafer and the thief plate.

As the paddle moves across the tank in a direction that is perpendicular to the first axis and parallel to the wafer flat, the bottom side remains a fixed distance from the wafer surface. When a current is applied to the electroplating solution, the paddle is moved to effectively mix the solution so that the electrolytes are kept in a uniform distribution within the tank. Once the paddle moves from a starting position along one side of the tank to an opposite side of the tank, the movement is reversed to return to the starting position and complete one cycle. Multiple cycles of paddle movement may be employed during an electroplating process and the rate of movement may be adjusted to optimize the rate of magnetic layer deposition.

A key feature according to one embodiment of the present disclosure is that a notch is formed in the paddle with an opening in the bottom side that corresponds to the width of K-block such that when the paddle passes over the wafer, one side of the notch is aligned above the side of K-block that is closest to the wafer flat and a second side of the notch is aligned above a K-block side opposite to that of the aforementioned K-block side. Thus, the notch is formed proximate to a first end of the paddle that passes over the wafer flat, and has a lengthwise dimension in a first axis direction and a width equivalent to the width of a paddle end along the second axis direction. In this case, the width of K-block is a dimension along a first axis direction that is perpendicular to the wafer flat and is typically smaller than the length of K-block which is along a second axis direction that is parallel to the wafer flat. From a cross-sectional view along a plane that bisects the paddle in a lengthwise dimension, the notch appears with a rectangular shape such that two sides formed perpendicular to the bottom side are of equal height and are connected by a top section that is parallel to the bottom side. Thus, the length of the top section of the notch is the distance between the two notch sides along the first axis direction and is essentially equal to the width of K-block. Moreover, the notch passes directly over K-block twice during each cycle of paddle movement. As the height of the notch along the third axis direction is increased up to about 50% of the entire height of the paddle, there is an increasingly greater thickness difference between magnetic layers electroplated in K-block compared with those deposited in other regions of the wafer.

According to a second embodiment, the notch formed in the paddle is modified such that the two sides are not of equal height from a cross-sectional view. In particular, the height of a first side of the notch that is nearer the first end of the paddle is greater than the height of the second side of the notch that is closer to a midpoint of the paddle. In one aspect, the second side may have a zero height which means the top section is tapered with respect to the bottom side and connects the first side with the bottom side. In other words, the height of the notch becomes smaller with increasing distance from the first end of the paddle that passes over the wafer flat. The advantage of the tapered notch is that the thickness within K-block may be controlled so that there is a steeper thickness gradient from a K-block side which is closer to the wafer flat to an opposite side adjacent to other blocks compared with the rectangular notch design.

There is a third embodiment wherein the first or second embodiment is modified to include a second notch proximate to the other (second) end of the paddle. The second notch may have two sides of equal height connected by a top section as previously described with respect to the first embodiment, or may have a tapered shape as in the second embodiment wherein a first side near the second end of the paddle is connected by a sloped section to the bottom side of the paddle. Preferably, the second notch passes directly over J-block during an electroplating process and in one aspect has a lengthwise dimension along a top section that is essentially equivalent to the width of J-block. Here width is defined as the distance between two long sides of J-block and is along an axis that is perpendicular to the wafer flat. The height of the second notch is typically less than the height of the first notch that passes over K-block since the CMP thinning rate of the electroplated layer in J-block is generally less than in K-block. As a result, the smaller height of the second notch causes a lesser thickness of magnetic layer to be formed in J-block compared with K-block, but still a greater magnetic layer thickness than in other blocks on the wafer.

According to a fourth embodiment, two paddles may be employed during an electroplating process and are maintained at a constant distance from each other during a paddle movement cycle. Preferably, a first paddle moves from a starting position along one side of the tank to a second position that is about halfway across the tank and stops with its lengthwise direction along an axis that is perpendicular to the wafer flat. Meanwhile, a second paddle has a starting position near the second position of the first paddle and moves to a side of the tank opposite the first side of the tank as the first paddle moves to its second position. The two paddles move back and forth across the bottom of the tank and above the wafer in concert (same direction) with the same rate of cycle movement. Preferably, the two paddles have an equivalent single or double notch design but the present disclosure also anticipates that one paddle may have a different notch design than the other paddle.

Conventional electroplating conditions may be used with the paddle designs of the present disclosure. For example, a substrate (wafer) is provided upon which a seed layer has been formed. Above the seed layer is a patterned photoresist layer with openings that correspond to the shape of the desired magnetic layer to be deposited in a subsequent step. A layer made of CoFe, NiFe, CoFe alloy such as CoFeNi, or a NiFe alloy is then electroplated on the substrate in an electroplating cell comprised of an anode and a cathode (working electrode) which are immersed in an electrolyte solution. A reference electrode with a stable, fixed voltage may be employed. Furthermore, there is a power source (potentiostat) with leads affixed thereto wherein one lead connects to the anode and supplies a positive voltage and a second lead connects to the cathode to provide a negative voltage when the cell is operating. A third lead connects to the reference electrode. Additives such as a stress reducer, surfactant, and leveling agent may be used to modify certain properties in the plated layer.

DETAILED DESCRIPTION

The present disclosure is a method of selectively electrodepositing a thicker metal or alloy layer on portions of a wafer that experience a higher thinning rate during a subsequent CMP process. Metal or alloy layer deposition is controlled by one or more notches in a paddle where a notch is positioned to pass directly over a region (block) on a wafer where a higher plating thickness is desired than in other regions of the wafer. The terms electroplating, plating, and electrodeposition may be used interchangeably. Although the exemplary embodiments relate to main pole layer deposition during the fabrication of magnetic recording heads, one skilled in the art will appreciate that the method disclosed herein may also be used to electroplate other materials such as permalloy, copper, gold, and the like in microelectronic devices or other applications.

Figure 3:
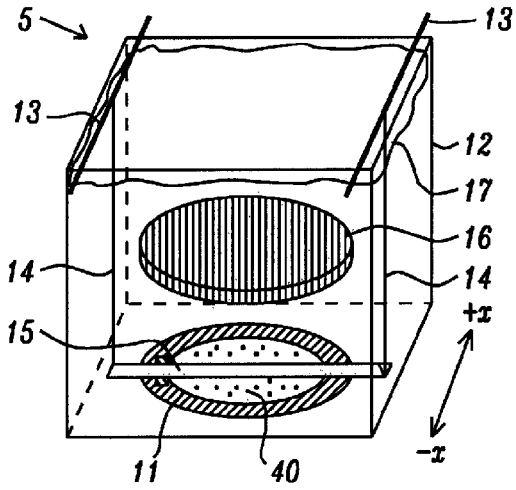
FIG. 3 is an oblique view of a plating cell used in the manufacture of magnetic recording heads and features a single paddle design.

Referring to FIG. 3, a typical plating apparatus 5 used in the manufacture of magnetic recording heads and that includes a paddle blade 15 previously utilized by the inventors is illustrated. A cathode assembly includes a wafer 40 to be plated that is mounted on a base plate (not shown) at the bottom of the cell (tank) 12, and a thief plate 11 which surrounds the wafer and serves as an auxiliary cathode to adjust within wafer thickness uniformity of the deposited metal or alloy layer. There is an anode 16 positioned above the wafer and immersed in the electroplating solution 17 within cell 12. The anode may be circular in shape and is held in place by supports (not shown) attached to the tank walls. A paddle assembly is also shown and includes a blade hereinafter referred to as paddle 15, two rails 13 aligned parallel to one another above the tank, and two vertical arms 14 wherein one vertical arm connects one end of the paddle to a first rail and a second vertical arm connects a second end of the paddle to a second rail. The vertical arms move in unison along the rails and thereby provide a mechanism to move the paddle 15 back and forth above the wafer surface to agitate the plating solution and provide the necessary mass transfer of components within the solution. A pump (not shown) may be employed to replenish the electroplating solution 17 from a reservoir. During a wafer plating operation, the anode and cathode are connected to a power supply (not shown).

It should be understood that a metal or alloy layer deposited according to the present disclosure is preferably formed on a seed layer (not shown) disposed on wafer 40. The wafer is generally comprised of a substrate that may be a write gap layer in a partially formed write head, for example. Furthermore, the partially completed write head may be formed on a read head structure in a combined read/write head configuration. The seed layer may be deposited by a sputtering process and preferably has the same composition as intended for the subsequently deposited metal or alloy layer. Typically, the fabrication process involves forming an insulation layer on a substrate. A photoresist layer is formed on the insulation layer and is patterned to define openings having the desired shape from a top view of the metal or alloy layer to be deposited in a subsequent step. A thin seed layer is deposited within the openings to promote the deposition of the magnetic layer during the electroplating process. Once the magnetic layer is electroplated to fill the openings, the photoresist layer is removed by a conventional process such as a chemical mechanical polish (CMP) process that also planarizes the metal or alloy layer across the entire wafer.

In one aspect, the electroplated metal or alloy layer is comprised of a soft magnetic material having a certain thickness and is made of CoFe or an alloy thereof such as CoFeNi, or is NiFe or a NiFe alloy. When the soft magnetic layer is a main pole layer in a write head, the deposited thickness is about 2 to 3 microns. However, the thickness of an electroplated magnetic layer according to the present disclosure may be less than 2 microns as appreciated by those skilled in the art.

In the exemplary embodiment, the plating solution 17 is aqueous based and is comprised of $Fe^{+2}$ and $Co^{+2}$ salts and optionally contains one or more other metal cations such as $Ni^{+2}$ that are added as chloride and/or sulfate salts. Boric acid ($H_3BO_3$) is preferably added to buffer the plating solution 17 and thereby maintains a pH in the range of 2.0 to 3.0. The plating solution also contains one or more aryl sulfinate salts such as sodium benzenesulfinate to reduce the amount of brighteners and leveling agents necessary for optimum properties in the electroplated magnetic layer and also to improve magnetic softness in the electroplated film. Other additives may be employed to optimize the performance of the plating solution. For example, saccharin may be used as a stress reducing agent and sodium lauryl sulfate may serve as a surfactant. In one embodiment, the plating solution 17 is maintained at a temperature between 10° C. and 25° C. Furthermore, either a direct current (DC) or pulsed DC mode may be used with a duty ratio of about 15% to 40% and a cycle time of about 30 to 1000 ms to supply a peak current density of 30 to 60 mA/cm$^2$ that powers the electroplating process. The duty ratio during each cycle may vary and is based on an "ON" time of 10 to 50 ms and an "OFF" time of 20 to 200 ms. Using these conditions, a magnetic layer comprised of CoFe, CoNiFe, or the like is deposited at the rate of about 500 to 1700 Angstroms per minute. Typically, the electroplating process is terminated after a predetermined length of time that corresponds to a desired thickness.

When a magnetic layer made of CoFe, CoFeNi, or the like is electroplated, the anode 16 is preferably Co (or Ni for a Ni alloy). A positive potential is applied to the anode and a negative potential is applied to the cathode comprised of thief plate 11 and wafer 40 by electrical leads (not shown) from the power source (not shown). As a result, an electroplating potential is established between the anode 16 and cathode such that an electric current flows from the anode to the cathode to drive the electroplating process. The wafer 40 is preferably affixed to a base plate by a clamp or other conventional means.

Figure 4A:
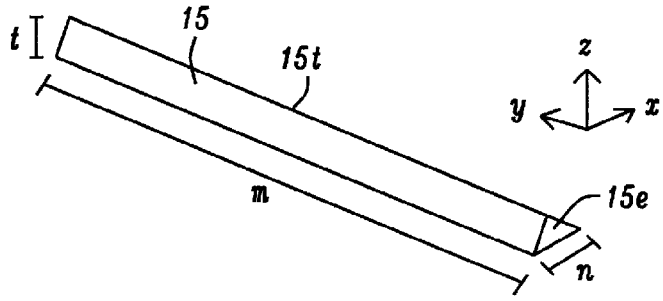
FIGS. 4*a* and 4*b* are an oblique view and cross-sectional view, respectively, of a conventional paddle design with three rectangular surfaces joined to form a triangular end shape in FIG. 4*a*.
Figure 4B:
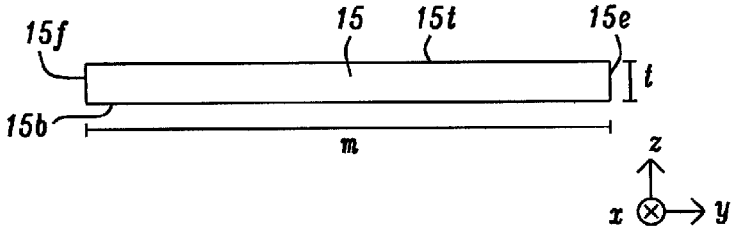

Referring to FIG. 4*a*, an oblique view of a conventional paddle 15 is pictured and shows a lengthwise dimension m along the y-axis for each of the three rectangular sides. A first or bottom side has a width n along the x-axis, and the second and third sides converge at a top edge 15*t* with a height t along the z-axis direction. Note that the three rectangular sides are joined along their edges to form a first triangular end 15*e*. The bottom side is a surface which faces wafer 40 when positioned in the cell 12. In FIG. 4*b*, a cross-sectional view is provided along a plane that includes top edge 15*t* and bisects the bottom side 15*b*. A second end 15*f* is shown opposite the first end 15*e*.

Figure 5A:
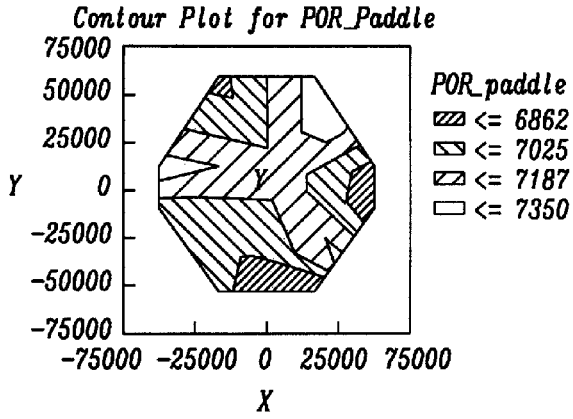
FIG. 5*a* is a thickness contour plot across a wafer following electroplating with the conventional paddle in FIG. 4*a*.
Figure 5B:
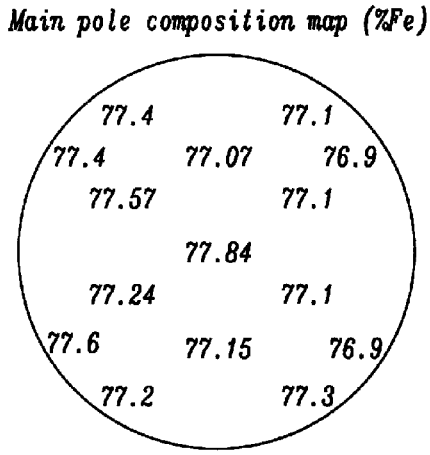
FIG. 5*b* shows a Fe composition map at various wafer locations for a main pole layer deposited with the conventional paddle design.

Referring to FIG. 5*a*, a contour plot is depicted for a CoFe layer that was electroplated using a conventional paddle 15 and shows thickness as a function of the x-axis and y-axis positions on the wafer. Note that the darker regions including K-block at the bottom of the plot have a thickness near 6700 Angstroms while the lighter gray regions have a thickness above 7000 Angstroms up to as high as 7350 Angstroms. Average plating thickness and uniformity are 0.6978+/−0.0194 microns. In FIG. 5*b*, the main pole composition in terms of % Fe in the electroplated CoFe film is illustrated for various sections of the wafer. Average Fe composition and sigma are 77.3% and +/−0.25%, respectively.

Figure 6A:
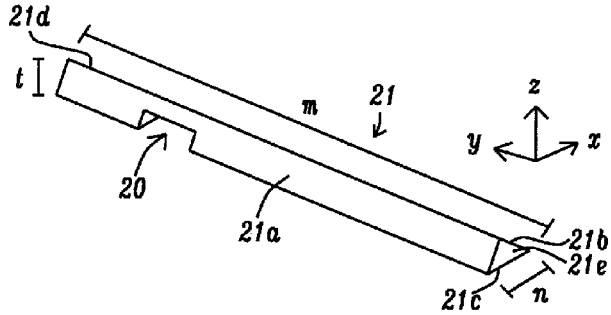
FIGS. 6*a* and 6*c* are an oblique view and cross-sectional view, respectively, of a notched paddle design according to a first embodiment of the present disclosure.

A key feature of the present disclosure is the paddle design that leads to a higher plating thickness in selected regions of the wafer such as K-block where thinning is greater during a subsequent CMP process. As a result, the higher plating thickness in K-block offsets a higher thinning rate in that region during the CMP step to yield a more uniform main pole thickness across the wafer at the completion of the main pole fabrication sequence. According to one embodiment shown in FIG. 6*a*, a rectangular shaped notch 20 is formed in paddle 21 that has three rectangular sides 21*a*-21*c* of equivalent length along a y-axis, and joined along their lengthwise edges to form two triangular ends as described previously with respect to paddle 15 in FIG. 4*a*. Two sides 21*a*, 21*b* are joined at a top edge 21*d* having a length m in a y-axis direction, and a third (bottom) side 21*c* has a width n in an x-axis direction. The three sides are joined to form a first end 21*e* with a triangle shape and a second end (not shown) with a similar shape at the opposite end of the paddle. Top edge 21*d* has a height t in a z-axis direction above bottom side 21*c*. The paddle 21 is preferably constructed from a plastic such as polyvinyl chloride (PVC) or another dielectric material.

According to one embodiment wherein the wafer diameter is 6 inches and the thief plate is a one inch wide ring around the entire edge of the wafer, there is a total distance of 8 inches across the wafer diameter and adjoining sections of thief plate ring on opposite sides thereof. In this example, the paddle length m is preferably about 9 inches such that a half inch section of paddle extends beyond the thief plate ring on opposite sides of the wafer when the paddle is aligned over a center of the wafer. When a larger size wafer with an 8 inch diameter, for example, is employed for the electroplating process, and the thief plate ring has a one inch width, then the paddle length m is increased accordingly to around 11 inches.

Figure 1:
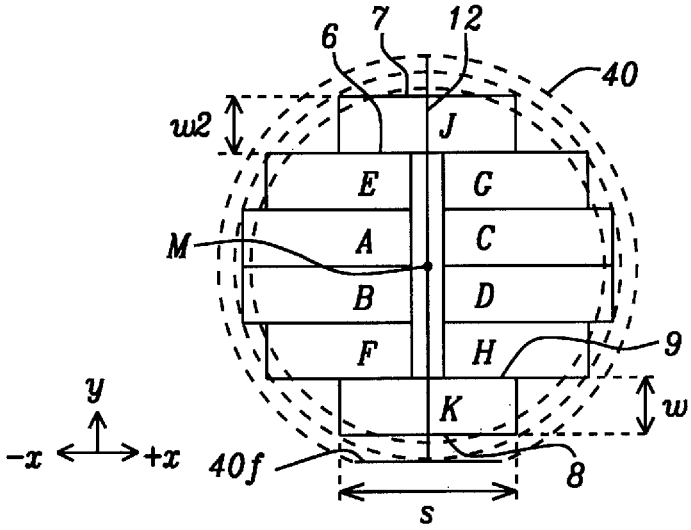
FIG. 1 is a top view of a typical ten block design used in the manufacture of magnetic recording heads.
Figure 2:
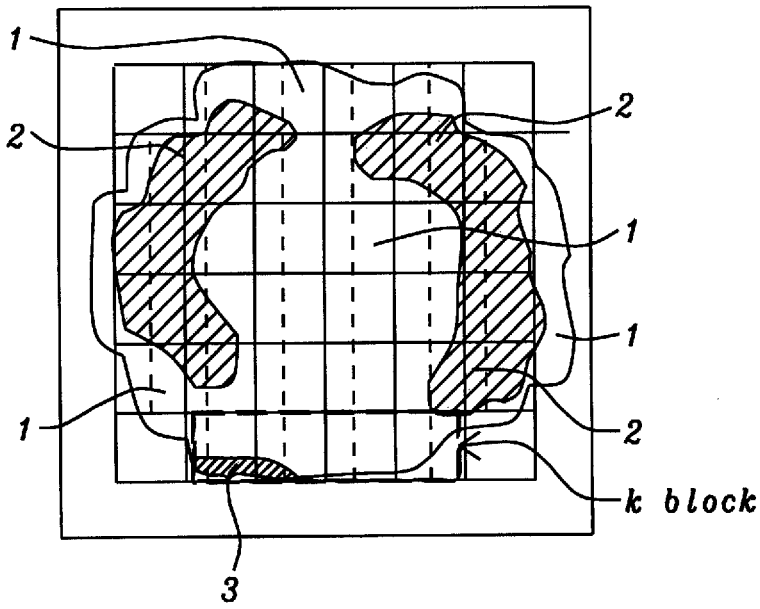
FIG. 2 is a top view of a wafer following main pole deposition and a subsequent CMP step that shows main pole thickness as a function of position on the wafer.
Figure 6B:
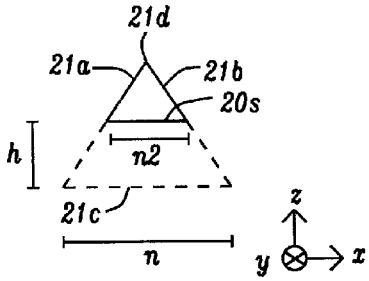
FIG. 6*b* is a cross-sectional view of the notch from a plane that is perpendicular to the top edge of the paddle and parallel to the ends.
Figure 6C:
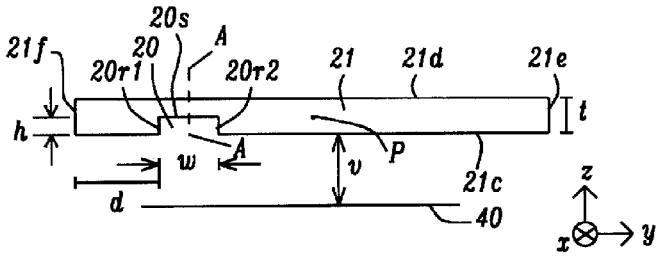

Referring to FIG. 6*c*, a cross-sectional view is taken along a y-axis plane that includes top edge 21*d* and bisects the bottom side 21*c*. The bottom side is shown facing a top surface of wafer 40 during an electroplating operation. The distance v between the wafer and bottom side 21*c* is about 1.5 to 2.5 mm and is kept essentially constant during a paddle movement cycle that is explained in a later section. As indicated previously, the length m of paddle 21 is preferably greater than the diameter of wafer 40 and thief plate (not shown) in order to provide more efficient agitation of the plating solution. In other words, first end 21*e* and second end 21*f* do not pass directly over the wafer or thief plate during a plating process. Notch 20 is formed closer to the second end 21*f* than to first end 21*e* wherein second end 21*f* is proximate to the portion of bottom side 21*c* that passes over K-block during a paddle movement cycle. Notch 20 has an open rectangular shape with two sides 20*r*1, 20*r*2 formed perpendicular to bottom side 21*c* and a top section 20*s* that connects sides 20*r*1 and 20*r*2 at a distance h from the bottom side. The rectangular shaped notch has an opening formed in bottom side 21*c*. Preferably, the distance w between the two sides 20*r*1 and 20*r*2 (length of top section 20*s*) corresponds to the width w of K-block (FIG. 1) and the distance d between side 20*r*1 and second end 21*f* is such that side 20*r*1 is aligned above K-block side 8, and side 20*r*2 is aligned above K-block side 9 during the portion of the plating process when the paddle 21 passes over K-block on wafer 40. In particular, first side 20*r*1 is closer to second end 21*f* than the top section 20*s* which extends from side 20*r*1 toward midpoint P of the paddle along the x-axis direction. The x-axis is formed at a 90° angle with respect to the y-axis and z-axis.

The width of K-block may vary depending on wafer diameter and layout of the device pattern. In an example where a six inch diameter wafer is used with a ten block design shown in FIG. 1, the width w of K-block and notch 20 is 0.875 inches.

Referring to FIG. 6*b*, a cross-sectional view is depicted along plane A-A in FIG. 6*c* and includes a portion of the notch 20 that is indicated by dashed lines. Note that the bottom of the notch is an opening formed in bottom side 21*c*. Portions of sides 21*a*, 21*b* are removed up to a height h, and the distance along an x-axis direction on top section 20*s* between sides 21*a*, 21*b* is n2.

Figure 7A:
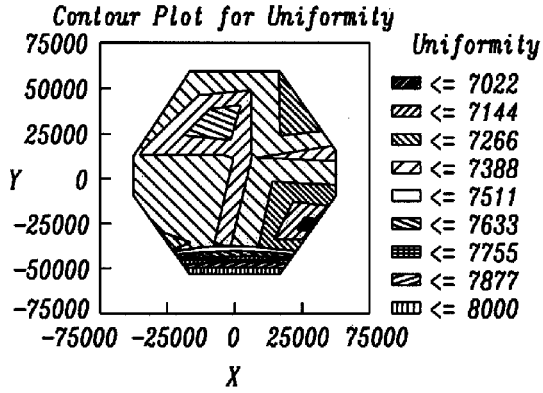
FIG. 7*a* is a thickness contour plot across a wafer following electroplating with the paddle design in FIG. 6*a*.

Referring to FIG. 7*a*, a contour plot is depicted for an electroplated CoFe layer formed according to the first embodiment wherein a notched paddle is employed. The data was generated with a paddle 21 having a 9 inch length m and where the notch height h=6 mm, paddle height t=12 mm, and notch width w=0.875 inches. In this case, thickness of the electroplated layer in the K-block region at the bottom of the wafer plot is substantially greater than in other portions of the wafer. Thickness is highest at the extreme bottom side of K-block along the wafer flat. In fact, K-block has a main pole thickness from around 7600 to 8000 Angstroms while other portions of the wafer have a thickness between about 7000 and 7500 Angstroms. The significant increase in plating thickness within K-block compared with a conventional method that has a standard paddle design means that the notch paddle design provides an important advantage in achieving within wafer uniformity. In a subsequent step (not shown), a chemical mechanical polish (CMP) process is performed to planarize the main pole layer surface. Because the CMP process thins the main pole layer at a faster rate in K-block, the resulting main pole layer thickness following CMP will be much more uniform across the wafer than previously realized in view of the thickness compensation from the notched paddle during the plating step. Furthermore, FIG. 7*b* indicates that the notched paddle design does not have any negative impact on main pole composition since the Fe content and sigma are 77.32+/−0.35% which are nearly the same as mentioned earlier for the standard paddle design. Plating thickness and uniformity in regions of the wafer other than K-block is 0.7168+/−0.0177 microns. Plating thickness delta between K-block and the remaining blocks is 778 Angstroms. These results indicate that while the magnetic layer thickness is adjusted higher as desired in K-block, film uniformity in the remaining blocks is maintained within an acceptable range.

Figure 7B:
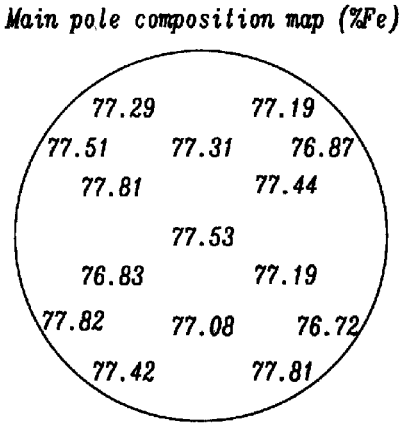
FIG. 7*b* shows a Fe composition map as a function of location on the wafer for a main pole layer deposited with the notched paddle design.
Figure 8:
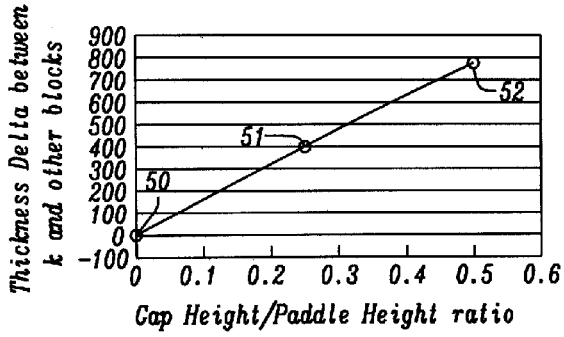
FIG. 8 is a graph showing the effect of the ratio of gap (notch) height to paddle height on the thickness delta between K-block and other blocks after main pole electroplating.

In FIG. 8, a plot is illustrated that shows the thickness differential between K-block and other blocks as a function of the gap (notch) height to paddle height ratio for a constant notch width w. Three data points 50, 51, 52 are connected by a straight line. Point 50 represents a conventional paddle design where bottom side 21*c* is uninterrupted and there is no notch. For point 51, the h/t ratio is 0.25:1 meaning that paddle height in FIG. 7*b* is four times greater than the height of notch 20. Point 52 represents a paddle design where h/t is 0.50:1 and the paddle height is 2× that of the notch height. With the notch design of the first embodiment, main pole layer thickness may be adjusted as much as 778 Angstroms higher than other blocks on wafer 40 where the mean thickness is around 7300 Angstroms (FIG. 7*a*). This thickness increase has been found to be adequate in compensating for a subsequent CMP process wherein thinning in K-block may be up to 10% greater than in other blocks on wafer 40. Preferably, the h/t ratio is from about 0.16:1 to 0.50:1, but may be adjusted higher or lower depending on the thickness non-uniformity generated by a particular CMP tool following the electroplating step.

In an alternative embodiment (not shown), the paddle 21 may have a circular shape, or a non-triangular shape such as a square or rectangle from an end view. An important feature is that a notch is formed in a paddle side that faces a wafer surface during an electroplating process. Preferably, the notch has a dimension along the lengthwise direction of the paddle that is essentially the same magnitude as the width of a region where a greater thickness of the electroplated layer is desired. In this case, the width of the region is between two parallel sides thereof and is measured in a direction that is perpendicular to the wafer flat. Furthermore, one side of the notch that is formed parallel to an end of the paddle is aligned above a first parallel side of the wafer region and an opposite side of the notch is aligned above a second parallel side of the wafer region during a paddle movement cycle. The ends of the paddle extend beyond the edge of the wafer and do not pass over the wafer during a paddle movement cycle.

Figure 9A:
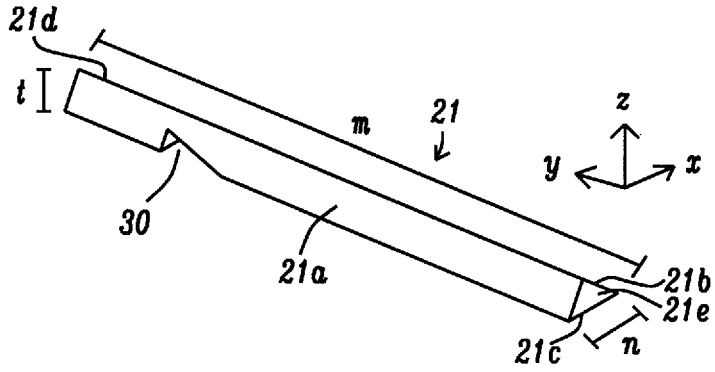
FIGS. 9*a* and 9*b* are an oblique view and cross-sectional view, respectively, of a tapered notch paddle according to a second embodiment of the present disclosure.
Figure 9B:
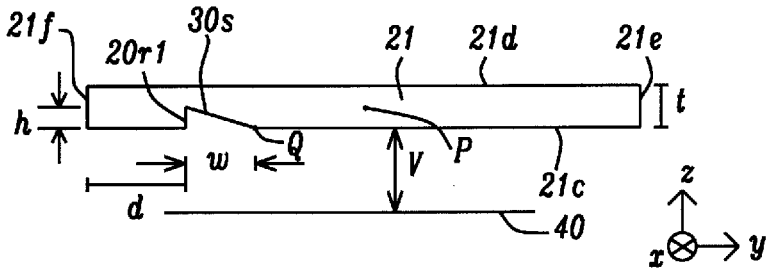

Referring to FIG. 9*a*, a second embodiment of the present disclosure is shown wherein the notched paddle design of the first embodiment is modified such that a notch forms a taper (slope) with respect to the bottom side. The height of the notch decreases with decreasing distance from the paddle midpoint P (FIG. 9*b*) and becomes zero where the tapered top section intersects with bottom side 21*c*. Referring to a cross-sectional view of the tapered notch design depicted in FIG. 9*b*, all dimensions of paddle 21 are retained from the previous embodiment shown in FIG. 6*a* and FIG. 6*b* except top section 20*s* and second notch side 20*r*2 in notch 20 are replaced by a single tapered side 30*s* to form notch 30. Notch side 20*r*1 has a height h above bottom side 21*c* as in the previous embodiment. There is a tapered side 30*s* that extends from a first end of side 20*r*1 to bottom side 21*c*. The length of the notch opening is w and extends from a second end of side 20*r*1 to a point Q where tapered side 30*s* intersects bottom side 21*c*. During a plating operation, side 20*r*1 is aligned above K-block side 8, and the intersection of tapered side 30*s* with bottom side 21*c* is aligned above side 9 wherein side 8 is the side formed closest to wafer flat 40*f* in FIG. 1. The second embodiment provides additional flexibility in that the plating thickness within K-block may be further controlled to provide a steeper gradient whereby a higher main pole thickness is deposited in rows of devices (not shown) along side 8 (FIG. 1) and the plating thickness decreases as the position in K-block moves toward side 9 but remains higher than in other blocks on the wafer. As explained earlier and depicted in FIG. 7*a*, the plating thickness within K-block may be adjusted to be greater than in other regions of the wafer depending on the notch height h. However, the contour gradient illustrated in FIG. 7*a* may be further modified to provide a steeper thickness gradient within K-block by incorporating the tapered notch paddle design in the second embodiment.

Figure 10:
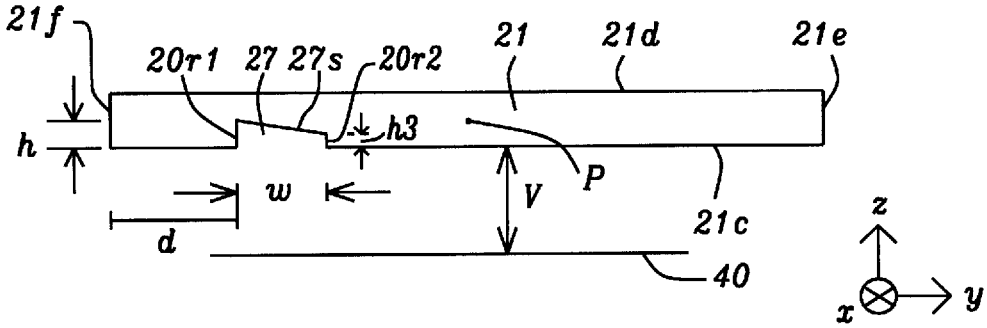
FIG. 10 is a cross-sectional view of a paddle with a tapered notch having two sides according to another embodiment of the present disclosure.

Referring to FIG. 10, the present disclosure also encompasses a third embodiment that is a hybrid of the first and second embodiments. According to a cross-sectional view along the y-axis direction, paddle 21 has a notch opening 27 with two sides of unequal height that are connected by a sloped top section 27*s*. In particular, both-sides 20*r*1 and 20*r*2 are retained from the first embodiment but side 20*r*2 has a lower height h3 than the height h for side 20*r*1. As a result, the top section 27*s* that connects an end of side 20*r*1 with an end of side 20*r*2 does not extend parallel to top edge 21*d* as in the first embodiment, but is tapered similar to tapered top section 30*s* in the second embodiment. In this case, the sloped top section does not connect with bottom side 21*c* but stops at an end of side 20*r*2 that is closer to paddle midpoint P than side 20*r*1.

Figure 11:
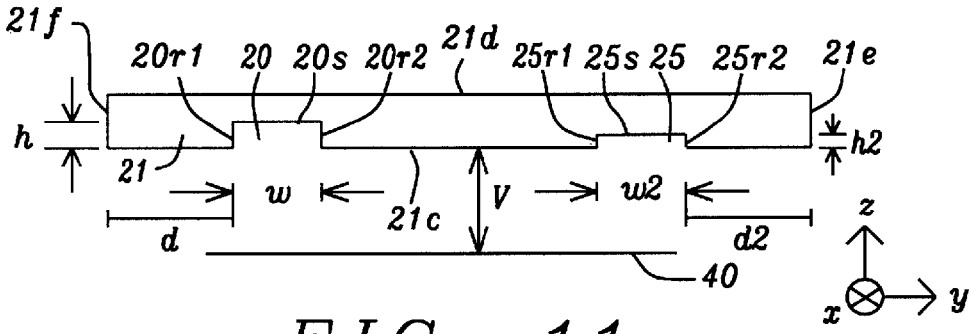
FIG. 11 is a cross-sectional view of a double notch paddle design according to a third embodiment of the present disclosure.

Referring to FIG. 11, a cross-sectional view is shown of a double notched paddle design that represents a fourth embodiment of the present disclosure. The dimensions of paddle 21 and notch 20 are retained from the first embodiment. However, a second notch 25 in the bottom side 21*c* is included that is proximate to the first end 21*e*. The second notch has a first side 25*r*1 and second side 25*r*2 formed perpendicular to bottom side 21*c* and a top section 25*s* having a width w2 that connects the sides 25*r*1, 25*r*2 at a distance h2 from the bottom side. Preferably, h2<h and the second side 25*r*2 is formed a distance d2 from first end 21*e* so that notch 25 passes directly over J-block on wafer 40 during an electroplating process. According to one embodiment, w=w2, and first side 25*r*1 is aligned above side 6 of J-block (FIG. 1) while second side 25*r*2 is aligned above side 7 of J-block during at least a portion of a paddle movement cycle. When the length s of K-block in FIG. 1 equals the length of J-block, then the paddle 21 will reside over each of the two blocks for an equal amount of time as the paddle moves in a (−)x and (+)x direction during each cycle. Furthermore, first notch 20 and second notch 25 will pass simultaneously over center line 12 during a paddle movement cycle. As a result, a greater electroplated layer thickness will be formed in J-block than in the other blocks A-H, but J-block thickness will be less than in K-block.

Although a rectangular shape is depicted for the second notch 25 in the exemplary embodiment, the second notch may have a tapered design as described in the second embodiment when the first notch 20 has a rectangular shape. In yet another embodiment, the first notch may be tapered as in the second embodiment and the second notch may have a rectangular shape as previously described. Moreover, one or both of the first and second notches may have two sides and a tapered top section as described with respect to the third embodiment.

Figure 12:
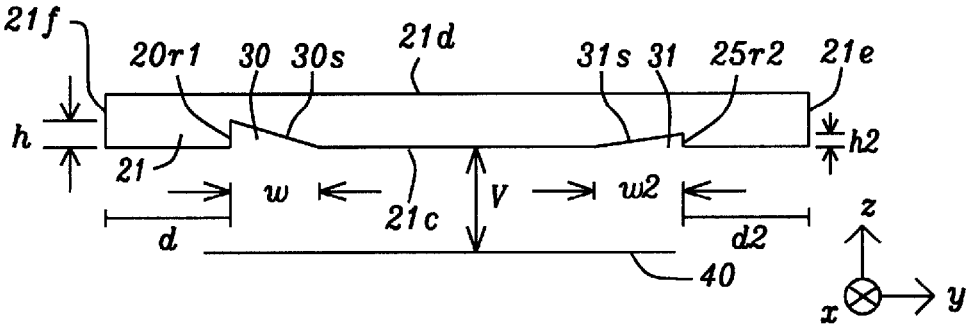
FIG. 12 is a cross-sectional view of a double notched paddle according to a fourth embodiment of the present disclosure.

Referring to FIG. 12, a fifth embodiment is depicted that has a double notched paddle wherein both of a first notch 30 and second notch 31 are tapered as in the second embodiment. In this case, first side 25*r*1 and top section 25*s* of the second notch in the fourth embodiment are replaced by a sloped top section 31*s* that extends from an end of second side 25*r*2 at the top of the second notch to the bottom side 21*c* at a distance w2 from the intersection of top section 25*s* with bottom side 21*c*. The advantage of the second notch 25 whether the shape is tapered or rectangular is to compensate for a higher thinning rate in J-block than in other regions except K-block during a subsequent CMP step. Although the CMP thinning rate of the main pole layer is generally not as high in J-block as in K-block, J-block may be thinned to a greater extent than the other eight blocks A-H excluding K-block. Therefore, the height h2 of the second notch 31 is typically less than the height h of the first notch 30 when the thickness differential between J-block and the bulk of the wafer is desired to be somewhat less than the thickness differential between K-block and the eight blocks A-H in the middle portion of the wafer.

Figure 13:
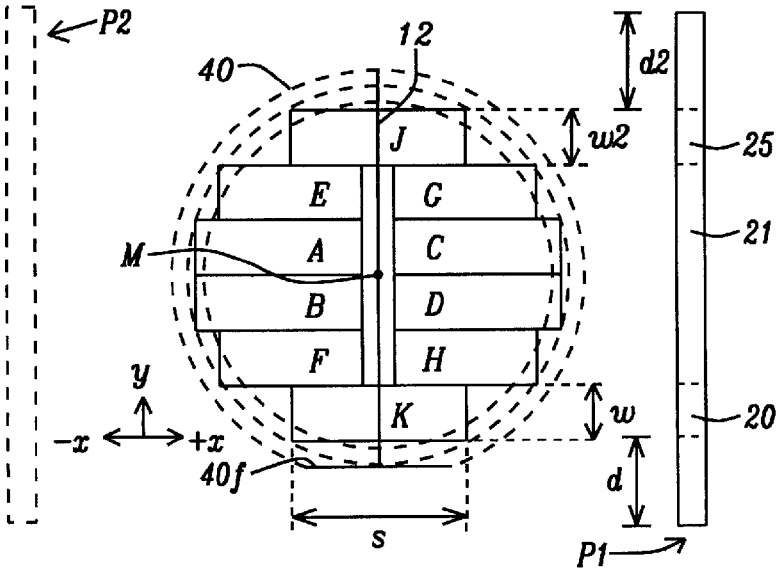
FIG. 13 is a top view showing the relative positions of a ten block wafer and a notched paddle according to an embodiment of the present disclosure.

Referring to FIG. 13, a top view of an exemplary embodiment wherein the anode is omitted to simplify the drawing, shows paddle 21 with a double notch design at a starting position P1 of a paddle movement cycle and at a mid-point location P2 during a paddle movement cycle in an electroplating process. Preferably, the width w of K-block is equivalent to the width of first notch 20, and the width w2 of J-block is equivalent to the width of second notch 25. During the first half of a paddle movement cycle when paddle 21 moves from P1 to P2 in a (−)x direction, first notch 20 passes directly over K-block and second notch 25 passes directly over J-block. In the second half of the cycle, paddle 21 moves in a (+)x direction and returns to P1 from P2 and passes a second time over K-block and J-block. Cycle time may vary but is typically about 1 cycle per second. The same paddle movement from P1 to P2 and back again occurs for all embodiments of a notched paddle design.

Figure 14:
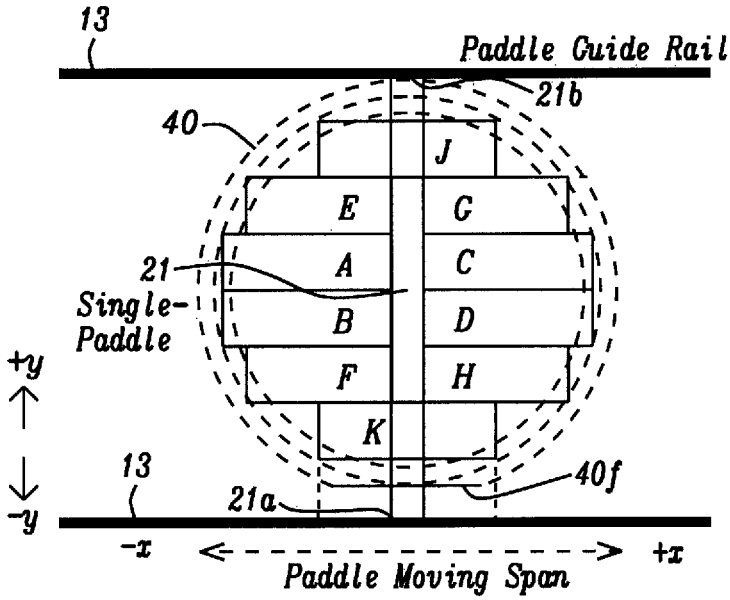
FIG. 14 is a top view that illustrates the movement of a single paddle above a wafer during an electroplating process.

In FIG. 14, the paddle moving span is shown again from a top view with paddle 21 located over the middle of the wafer 40 and attached to two guide rails 13 at either end of the paddle. The paddle is aligned perpendicular to wafer flat 40*f* and extends beyond the wafer flat in a (−)y-axis direction and beyond the top wafer edge in a (+)y-axis direction.

Figure 15:
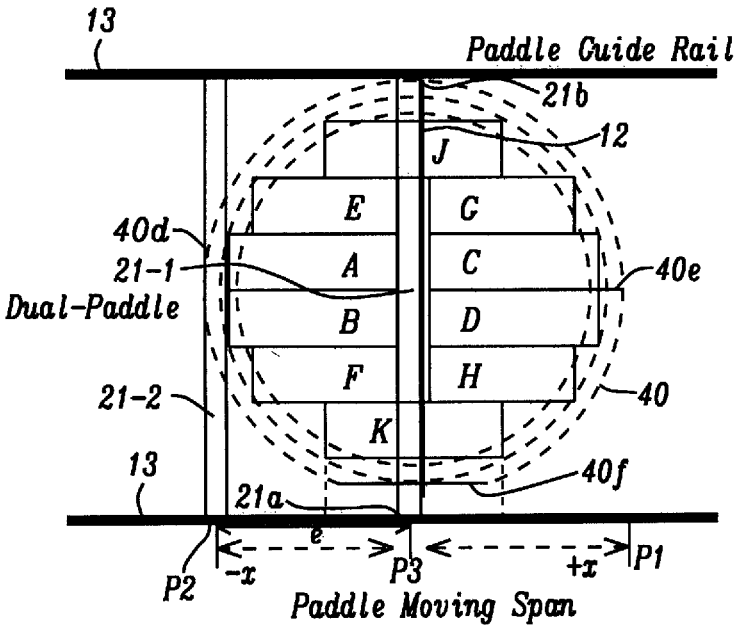
FIG. 15 is a top view that illustrates the movement of two paddles above a wafer during an electroplating step according to an embodiment of the present disclosure.

Referring to FIG. 15, a fifth embodiment of the present disclosure is depicted that has a paddle assembly comprised of two paddles. A first paddle 21-1 is connected to two rails 13 by a set of two vertical arms as described earlier with respect to paddle 15 in FIG. 3. There is a second paddle 21-2 connected to the two rails 13 by a second set of two vertical arms (not shown) wherein one vertical arm is attached to one end of paddle 21-2 and another vertical arm is attached to an opposite end of the second paddle. Preferably, the first paddle 21-1 moves from a starting position P1 to a second position P3 in a (−)x-axis direction and then back again to P1 in a (+)x-axis direction to complete one movement cycle. Meanwhile, the second paddle 21-2 moves in concert with the first paddle and maintains a fixed distance e from the first paddle during the electroplating process. Therefore, when paddle 21-1 is at a starting position P1, paddle 21-2 is at position P3. When paddle 21-1 is at position P3 at the mid-point of a cycle, paddle 21-2 is at position P2. It follows that both paddles have the same rate of movement in cycles/minute and the same number of cycles completed during an electroplating operation. However, paddle 21-1 moves only over the right half portion of wafer 40 that is located between right edge 40*e* and center line 12 which is perpendicular to wafer flat 40*f* and intersects a midpoint thereof. Meanwhile, paddle 21-2 moves only over the left half of the wafer between center line 12 and the left edge 40*d* of the wafer. The advantage of two paddles moving in concert is for improved thickness uniformity between right and left halves of the wafer. The first and second paddles each have a length along the y-axis that is greater than a distance that includes a diameter of the wafer, and the width of the thief plate ring on opposite sides of the wafer. Thus, for a 6 inch diameter wafer and a 1 inch wide thief plate ring, a preferred length for the first and second paddles is about 9 inches.

According to one embodiment of the present disclosure, a magnetic field is applied along the x-axis, for example, during the deposition of the main pole layer on wafer 40. However, a magnetic field may not be applied during the electroplating. Moreover, there may be an anneal process involving the application of a magnetic field parallel to the film plane following the electroplating process that further improves softness in the main pole layer. The annealing process is preferably carried out in an oven after the electroplated substrate is removed from the electroplating bath. Magnetic annealing is one of the most common methods used with magnetic layers in write heads in order to improve writer performance. Generally, only a hard-axis anneal or an easy-axis anneal is employed during writer fabrication. However, the present disclosure also anticipates a two step anneal process wherein the electroplated layer is subjected to a hard axis anneal and then to an easy axis anneal. The anneal steps are preferably performed at a temperature between 180° C. and 250° C. so that a read head adjacent to the write head in a combined read/write head structure is not damaged. In addition, the applied magnetic field during the anneal steps is kept at 300 Oe or less to prevent altering the preferred direction of magnetic moment in the pinned layer within the read head.

Following the anneal step, a conventional CMP process is preferably performed to planarize the electroplated layer. As mentioned previously with respect to the preferred embodiments, a single notch or double notch paddle design is advantageously employed during the electroplating process to selectively deposit a greater main pole thickness in one or more regions of a wafer to offset a higher thinning rate in those same regions during the CMP process. Furthermore, the tapered notch design enables additional flexibility in that the thickness gradient within certain regions such as K-block and J-block may be controlled to form a higher magnetic layer thickness along a side of the block that is closer to the wafer edge and a lower thickness along an opposite side of the block. The height of the notch may be increased to increase the thickness differential between the magnetic layer thickness in K-block, for example, and other blocks on the wafer. It should be understood that the electroplated layer need not be magnetic since a Cu layer or other metal or alloy layers may be electroplated for other applications according to the method described herein and still benefit from improved thickness uniformity across the wafer following a subsequent CMP process. The single or dual notch design having a rectangular or tapered notch may be formed in a non-triangular paddle with a circular, rectangular, or square shape, for example, from an end view.

While this disclosure has been particularly shown and described with reference to, the preferred embodiment thereof, it will be understood by those skilled in the art that various changes in form and details may be made without departing from the spirit and scope of this disclosure.

We claim:

1. A paddle made of a dielectric material for an electroplating process wherein the paddle has two ends that are connected by a middle section, and has a single notch formed in a bottom side and extending into two sides adjacent to the bottom side and faces a wafer during a portion of a paddle movement cycle in an electroplating bath during an electroplating process wherein the single notch is proximate to a first end of the paddle and is configured to pass over an outer region on a wafer where a greater thickness of electroplated material is desired, and a distance between the two ends is greater than a diameter of the wafer so that the two ends do not pass over the wafer during any portion of the paddle movement cycle, the single notch has a lengthwise dimension related to a width of the outer region.

2. The paddle of claim 1 wherein the outer region on the wafer has two parallel sides that are aligned parallel to a flat on the wafer, and a distance between the two parallel sides is the width of the outer region.

3. The paddle of claim 2 wherein the lengthwise dimension is between a first side and a second side of the single notch which are formed parallel to the two paddle ends, the lengthwise dimension is essentially equal to the width of the outer region on the wafer.

4. The paddle of claim 3 wherein the first side of the single notch is aligned above a first parallel side of the outer region, and the second side of the single notch is aligned above a second parallel side of the outer region during a portion of the paddle movement cycle.

5. A paddle made of a dielectric material for an electroplating process, comprising:

(a) said paddle having three sides each having a rectangular shape and an equal length along a first axis direction; wherein each of said sides are joined at their lengthwise edges to form a triangle shape from an end view, a first or bottom side that faces a wafer in an electroplating bath during an electroplating process has a first width along a second axis, and second and third sides are joined to form a top paddle edge that is a first height distance along a third axis from the bottom side, and wherein the first, second, and third axes are formed at 90 degree angles with respect to each other;

(b) two triangular shaped ends; and (c) a notch formed in the bottom side that extends into portions of the second and thirds sides, wherein the notch is an opening having a first length along the first axis, a first width along the second axis, and a second height along the third axis that is less than the first height, and wherein the notch has a first side formed perpendicular to the bottom side that is closer to a first triangle shaped paddle end than a top section that extends from the first side of the notch toward a midpoint of the paddle.

6. The paddle of claim 5 wherein the notch has a rectangular shape from a cross-sectional view along a first axis direction and is further comprised of a second side wherein the first side and second side of the notch are each formed perpendicular to the bottom side and have a second height, the top section is at a second height from the bottom side and extends a first length from the first side to the second side along the first axis direction.

7. The paddle of claim 6 further comprised of a second notch having a rectangular shape from a cross-sectional view along the first axis and formed in the bottom side and extending into portions of the second and thirds sides, the second notch is an opening having a second length along the first axis, a first width along the second axis, and a fourth height along the third axis that is less than the second height of the first notch, the second notch has a first side that is closer to a second triangle shaped paddle end than a second side that is closer to a paddle midpoint, and the second notch has a top section that is a fourth height distance from the bottom side and connects the first and second sides.

8. The paddle of claim 7 wherein the second height/first height ratio is from about 0.16:1 to 0.50:1.

9. The paddle of claim 7 wherein the first length of the first notch is equivalent to the second length of the second notch.

10. The paddle of claim 5 wherein the notch has a tapered shape from a cross-sectional view along a first axis direction, the top section extends from a first end of the first side to the bottom side wherein a distance between the second end of the first side and an intersection point of the top section with the bottom side is the first length of the notch, and the distance along a third axis direction between the top section and bottom side decreases with a decreasing distance from the paddle midpoint.

11. The paddle of claim 10 further comprised of a tapered second notch from a cross-sectional view along a first axis direction, the second notch is an opening having a second length along the first axis at the bottom side and extends into portions of the second and thirds sides, the second notch has a first width along the second axis, and a fourth height less than the second height in a third axis direction along a first side that is closer to a second triangle shaped end than a sloped top section that extends from the first side of the second notch to the bottom side.

12. The paddle of claim 5 wherein the notch is further comprised of a second side wherein the first side and second side of the notch are each formed perpendicular to the bottom side from a cross-sectional view along a first axis direction, the first side has a second height greater than a third height of the second side, the first side has a second end that is separated by a first length along the bottom side from a second end of the second side, and the top section is sloped with respect to the bottom side and connects a first end of the first side to a first end of the second side.

13. The paddle of claim 5 wherein the first length of the first notch is determined by the width of a rectangular region on a wafer on which a greater thickness of electroplated layer is to be deposited, the first length is essentially equivalent to the distance between two sides of the rectangular region that are aligned parallel to a wafer flat.

14. A method of selectively depositing a greater metal or alloy layer thickness on certain regions of a wafer during an electroplating process; comprising:

(a) providing an electroplating cell with an anode and a cathode assembly immersed in an electroplating solution, the cathode assembly includes a wafer mounted on a base plate and a thief plate surrounding the wafer;

(b) providing a paddle assembly including two rails above the electroplating cell, a first vertical arm that connects a first end of a paddle to a first rail and a second vertical arm which connects a second end of the paddle to a second rail, and the paddle that comprises:

(1) three sides each with a rectangular shape and having an equal length along a first axis direction; each of the sides are joined at their lengthwise edges to form a triangle shape from an end view wherein a first or bottom side that faces the wafer has a first width along a second axis, and second and third sides are joined to form a top paddle edge that is a first height distance along a third axis from the bottom side wherein the first, second, and third axes are formed at 90 degree angles with respect to each other;

(2) the first and second ends each with a triangular shape; and (3) a notch formed in the bottom side that extends into portions of the second and thirds sides, wherein the notch is an opening having a first length along the first axis, a first width along the second axis, and a second height along the third axis that is less than the first height, and wherein the notch has a first side that is closer to the first paddle end than a top section that extends from the first side of the notch toward a midpoint of the paddle; and (c) moving the paddle back and forth across the tank during a plurality of movement cycles and at a certain distance above the wafer while a positive potential is applied to the anode and a negative potential is applied to the cathode assembly, the notch passes directly over a rectangular region on the wafer where a greater thickness of electroplated material is desired and the first length is essentially equivalent to the distance between two sides of the rectangular region that are aligned parallel to a wafer flat.

15. The method of claim 14 wherein the electroplated layer is CoFe, a CoFe alloy, NiFe, a NiFe alloy, Cu, or Au.

16. The method of claim 14 wherein the notch has a rectangular shape from a cross-sectional view along a first axis direction and is further comprised of a second side wherein the first side and second side of the notch are each formed perpendicular to the bottom side and have a second height, the top section is at a second height from the bottom side and extends a first length from the first side to the second side along the first axis direction.

17. The method of claim 16 wherein the paddle is further comprised of a second notch having a rectangular shape from a cross-sectional view along the first axis and formed in the bottom side and extending into portions of the second and thirds sides, the second notch is an opening having a second length along the first axis, a first width along the second axis, and a fourth height along the third axis that is less than the second height of the first notch, the second notch has a first side that is closer to the second paddle end than a second side that is closer to the paddle midpoint, and the second notch has a top section that is a fourth height distance from the bottom side and connects the first and second sides, the second notch passes directly over a second rectangular region of the wafer where a greater electroplated layer is desired, and the second length is essentially equivalent to the distance between two sides of the second rectangular region that are aligned parallel to the wafer flat.

18. The method of claim 14 wherein the notch has a tapered shape from a cross-sectional view along a first axis direction, the top section extends from a first end of the first side to the bottom side wherein a distance between the second end of the first side and an intersection point of the top section with the bottom side is the first length of the notch, and the distance along a third axis direction between the top section and bottom side decreases with a decreasing distance from the paddle midpoint.

19. The method of claim 18 wherein the paddle is further comprised of a tapered second notch from a cross-sectional view along a first axis direction, the second notch is an opening having a second length along the first axis at the bottom side and extends into portions of the second and thirds sides, the second notch has a first width along the second axis, and a fourth height less than the second height in a third axis direction along a first side that is closer to the second paddle end than a sloped top section that extends from the first side of the second notch to the bottom side, the second notch passes directly over a second rectangular region of the wafer where a greater electroplated layer is desired, and the second length is essentially equivalent to the distance between two sides of the second rectangular region that are aligned parallel to the wafer flat.

20. The method of claim 14 wherein the notch is further comprised of a second side wherein the first side and second side of the notch are each formed perpendicular to the bottom side from a cross-sectional view along a first axis direction, the first side has a second height greater than a third height of the second side, the first side has a second end that is separated by a first length along the bottom side from a second end of the second side, and the top section is sloped with respect to the bottom side and connects a first end of the first side to a first end of the second side.

21. The method of claim 14 wherein the second height/first height ratio is from about 0.16:1 to 0.50:1.

22. The method of claim 14 wherein the length of the three rectangular paddle sides along the first axis direction is greater than a distance that includes a diameter of the wafer, a width of the thief plate ring on a first side of the wafer, and a width of the thief plate ring on a side opposite the first side of the wafer.

23. A method of selectively depositing a greater metal or alloy layer thickness on certain regions of a wafer during an electroplating process; comprising:

(a) providing an electroplating cell with an anode and a cathode assembly immersed in an electroplating solution, the cathode assembly includes a wafer mounted on a base plate and a thief plate surrounding the wafer;

(b) providing a paddle assembly including two rails above the electroplating cell, a first vertical arm that connects a first end of a first paddle to a first rail and a second vertical arm which connects a second end of the first paddle to a second rail, a third vertical arm that connects a first end of a second paddle to the first rail and a fourth vertical arm that connects a second end of the second paddle to the second rail wherein the first and second paddles are separated by a fixed distance during the electroplating process, and the first and second paddles each comprise:

(1) three sides each with a rectangular shape and having an equal length along a first axis direction; wherein each of the sides are joined at their lengthwise edges to form a triangle shape from an end view wherein a first or bottom side that faces the wafer has a first width along a second axis, and second and third sides are joined to form a top paddle edge that is a first height distance along a third axis from the bottom side wherein the first, second, and third axes are formed at 90 degree angles with respect to each other;

(2) the first and second ends each with a triangular shape; and (3) a notch formed in the bottom side that extends into portions of the second and thirds sides, wherein the notch is an opening having a first length along the first axis, a first width along the second axis, and a second height along the third axis that is less than the first height, and wherein the notch has a first side that is closer to the first paddle end than a top section that extends from the first side of the notch toward a midpoint of the paddle; and (c) moving the first paddle back and forth across one half of the wafer while moving the second paddle back and forth across a second half of the wafer during a plurality of movement cycles and at a certain distance above the wafer while a positive potential is applied to the anode and a negative potential is applied to the cathode assembly, the notch in the first paddle and the notch in the second paddle pass directly over adjacent portions of first and second rectangular regions, respectively, on the wafer where a greater thickness of electroplated material is desired and the first length is essentially equivalent to the distance between two sides of each of the first and second rectangular regions that are aligned parallel to a wafer flat.

24. The method of claim 23 wherein the electroplated layer is CoFe, a CoFe alloy, NiFe, a NiFe alloy, Cu, or Au.

25. The method of claim 23 wherein the notch in each of the first and second paddles has a rectangular shape from a cross-sectional view along a first axis direction and is further comprised of a second side wherein the first side and second side of the notch are each formed perpendicular to the bottom side and have a second height, the top section is at a second height from the bottom side and extends a first length from the first side to the second side along the first axis direction.

26. The method of claim 23 wherein the notch in each of the first and second paddles has a tapered shape from a cross-sectional view along a first axis direction, the top section extends from a first end of the first side to the bottom side wherein a distance between the second end of the first side and an intersection point of the top section with the bottom side is the first length of the notch, and the distance along a third axis direction between the top section and bottom side decreases with a decreasing distance from the paddle midpoint.

27. The method of claim 23 wherein the length of the three rectangular paddle sides along the first axis direction in each of the first and second paddles is greater than a distance that includes a diameter of the wafer, a width of the thief plate ring on a first side of the wafer, and a width of the thief plate ring on a side opposite the first side of the wafer.

* * * * *